US005482214A

United States Patent [19]

Talacko

[11] Patent Number: 5,482,214

[45] Date of Patent: Jan. 9, 1996

[54] ELECTROSTATIC POWDER-COATING GUN

[75] Inventor: Radovan Talacko, St. Gallen, Switzerland

[73] Assignee: Wagner International AG, Alstatten, Switzerland

[21] Appl. No.: 991,504

[22] Filed: Dec. 17, 1992

[30] Foreign Application Priority Data

Dec. 17, 1991 [DE] Germany ..... 41 41 663.5

[51] Int. Cl.[6] ..... B05B 5/025

[52] U.S. Cl. ..... 239/698; 239/705; 239/707; 239/708

[58] Field of Search ..... 239/3, 690, 697, 239/698, 704, 705, 706, 707, 708, 105, 468, 469, 470; 118/621, 627, 629

[56] References Cited

U.S. PATENT DOCUMENTS

| | | | |
|---|---|---|---|
| 3,608,823 | 9/1971 | Buschor . | |
| 3,901,184 | 8/1975 | Payne et al. | 239/698 X |
| 4,114,810 | 9/1978 | Masuda . | |
| 4,462,061 | 7/1984 | Mommsen | 239/707 X |
| 4,634,058 | 1/1987 | Hollstein et al. | 239/707 X |
| 4,706,890 | 11/1987 | Talacko | 239/705 X |
| 4,747,546 | 5/1988 | Talacko | 239/707 |
| 4,752,034 | 6/1988 | Kuhn et al. | 239/707 X |
| 4,772,982 | 9/1988 | Nagasaka | 239/707 X |
| 4,775,105 | 10/1988 | Rese | 239/704 |
| 4,784,331 | 11/1988 | Sharpless et al. | 239/698 |
| 4,788,933 | 12/1988 | Buschor | 239/698 X |
| 4,802,625 | 2/1989 | Buschor | 239/706 X |
| 4,819,879 | 4/1989 | Sharpless et al. | 239/707 X |
| 4,828,185 | 5/1989 | Rese | 239/707 X |
| 4,830,279 | 5/1989 | Crum et al. | 239/707 X |
| 4,979,680 | 12/1990 | Bauch et al. | 239/708 X |
| 5,056,720 | 10/1991 | Crum et al. | 239/698 |

FOREIGN PATENT DOCUMENTS

| | | |
|---|---|---|
| 0236794 | 9/1987 | European Pat. Off. . |
| 0227992 | 9/1989 | European Pat. Off. . |
| 2514411 | 2/1976 | Germany . |
| 2642587 | 4/1982 | Germany . |
| 3529703 | 8/1986 | Germany . |

*Primary Examiner*—William Grant
*Attorney, Agent, or Firm*—Hill, Steadman & Simpson

[57] ABSTRACT

An electrostatic powder-coating gun is provided which comprises a powder duct which is connected to a supply conduit for a powder-air-mixture and arranged along the longitudinal axis of the gun barrel and having an open mouth towards the work to be coated, a high-voltage generator, an electrode supporting tube extending through the powder duct in axial direction thereof, and a high-voltage electrode located on the supporting tube and protruding beyond the mouth of the powder duct towards the work. The high-voltage generator and the powder duct are disposed in series along the longitudinal axis of the powder tube in such a way that the powder duct is adjacent the muzzle of the gun barrel. The powder duct is comprised of a toroidal duct and an annular channel extending therefrom and opening to the outside.

15 Claims, 1 Drawing Sheet

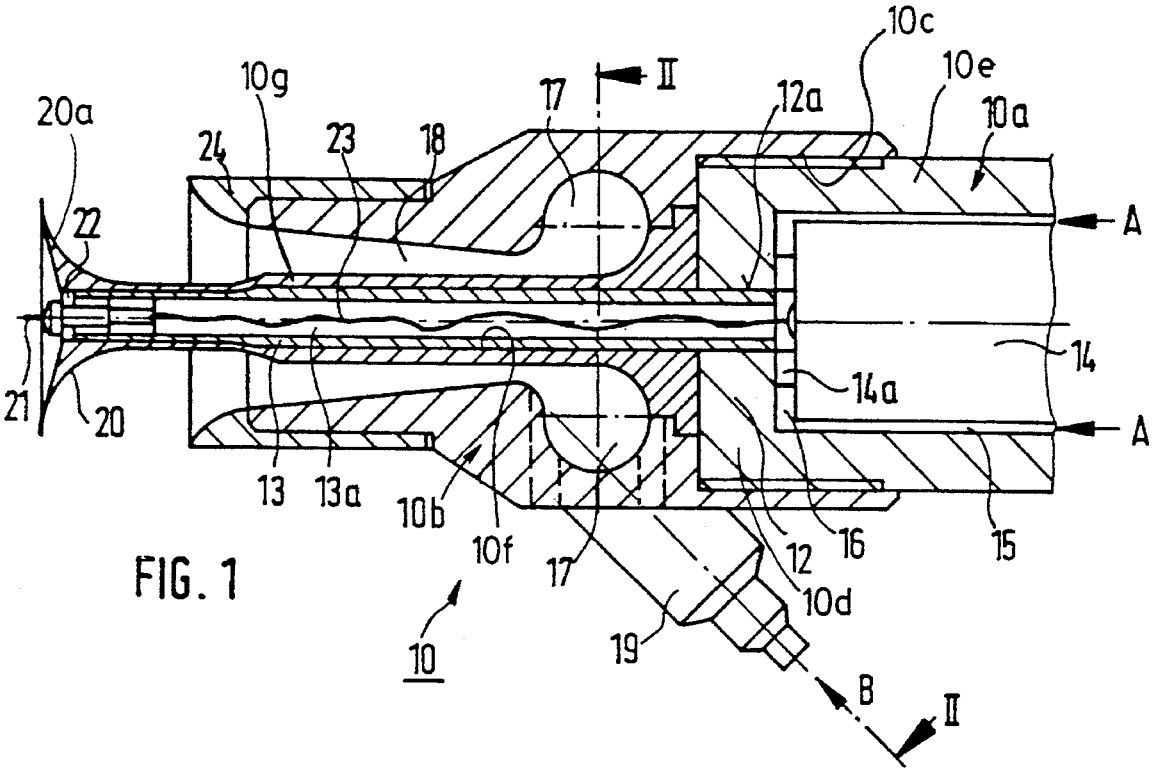
FIG. 1
FIG. 2
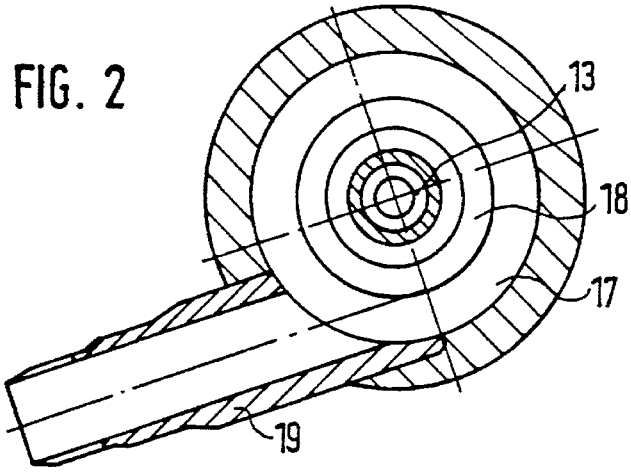
FIG. 3
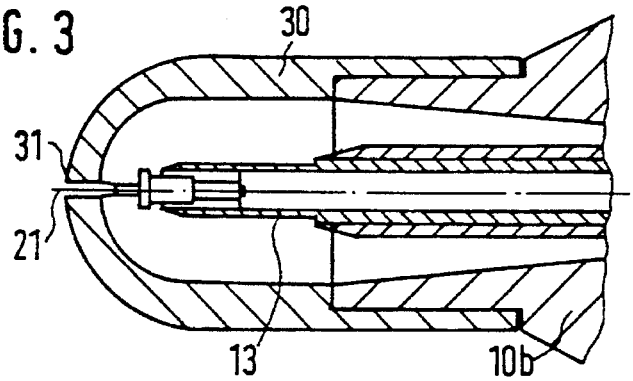

ELECTROSTATIC POWDER-COATING GUN

BACKGROUND OF THE INVENTION

The present invention is directed to an electrostatic powder-coating gun generally, and in particular to a gun having a gun barrel, the gun comprising a powder duct which is connected to a supply conduit for a powder-air-mixture and arranged along the longitudinal axis of the gun barrel towards the work to be coated and terminating in a mouth; a high-voltage generator connected to a power supply line; and a high-voltage electrode which is located protruding beyond the mouth of the powder duct towards the work and connected to the high-voltage generator via a conductor. Electrostatic powder-coating guns of such construction have been known for a long time and various designs are commercially available.

In general, with such known coating guns the powder-air-mixture is fed through the grip or adjacent the grip, the powder duct extending through the entire length of the gun barrel. The high-voltage generator is located in parallel with the powder duct either within or on the grip or within or on the gun barrel. However, this results in an elongated flow path for the powder-air-mixture inside the gun so that the air for feeding the powder requires a high pressure in order to overcome the flow resistance within the gun. Also, the flow of powder through the elongated powder duct results in a comparatively high wear of parts due to abrasion. Finally, the arrangement of powder duct and high-voltage generator in side-by-side relationship requires that either the grip or the gun barrel must have relatively large dimensions.

SUMMARY OF THE INVENTION

It is the objective of the present invention to provide an electrostatic powder-coating gun in which the flow path of the powder-air-mixture inside the gun is comparatively short and effective so that flow resistance and abrasion will be reduced while the grip and gun barrel may be of slender design.

The solution of this objective is accomplished by an electrostatic powder-coating gun having a gun barrel, comprising a powder duct which is connected to a supply conduit for a powder-air-mixture and is arranged along the longitudinal axis of the gun barrel towards the work to be coated. The powder duct terminates in a mouth. A high-voltage generator is mounted in the gun and is connected to a power supply line. An electrode supporting tube extends through the powder duct in axial direction thereof. A high-voltage electrode is located on, at, or in the supporting tube and protrudes beyond the mouth of the powder duct towards the work. The electrode is connected to the high-voltage generator via a conductor passing through the supporting tube. The high-voltage generator and the powder duct are disposed in series along the longitudinal axis of the gun barrel. The powder duct comprises a toroidal powder duct coaxial with the electrode supporting tube, and an annular channel extending to said mouth. The supply port for the powder-air-mixture extends into the toroidal powder duct tangentially at an inclination to the longitudinal axis. The annular channel can be shaped as a diffuser tube.

Hence, the powder duct of the powder-coating gun of the present invention is very short and occupies only the foremost portion of the gun barrel. Furthermore, due to the configuration of the powder duct as a toroidal with adjacent diffuser tube, there results particularly beneficial flow conditions. Consequently, only a comparatively low discharge air pressure is required and abrasion along the duct walls is minimized. The space within the gun barrel behind the powder duct is fully available for the high-voltage generator so that the gun barrel may be made very slender; the same benefit applies to the grip in the case of a manually operated gun. Also, the area of the walls where powder particles could be deposited is reduced and the deposition of powder particles is additionally minimized by the inclined tangential flow.

A particularly advantageous further improvement of the present invention provides an annular gap arranged between the high-voltage generator and an inner wall of the gun barrel, the annular gap being in communication with a pressurized-air supply means, on the one hand, and with the interior space of the electrode supporting tube, on the other hand, the interior space opening adjacent the high-voltage electrode. Here, pressurized air flows around the high-voltage generator so that no static charges will result, and this flow of flushing air also serves to keep the electrode free from powder deposits.

BRIEF DESCRIPTION OF THE DRAWINGS

FIG. 1 is a longitudinal sectional view through a front portion of a powder-coating gun according to the invention;

FIG. 2 is a cross-sectional view generally along the line II—II of FIG. 1; and FIG. 3 is a fragmentary longitudinal sectional view of a modification of the powder-coating gun of FIG. 1.

DETAILED DESCRIPTION OF THE PREFERRED EMBODIMENTS

The foremost portion of a gun barrel 10 of the electrostatic powder-coating gun of the present invention, as illustrated in FIG. 1, comprises a barrel main member 10*a* and a barrel extension 10*b* screwed to the main member 10*a* within a mouth portion 10*c* of the extension 10*b*. An end 10*d* of the barrel main member 10*a* is closed by a cover wall 12 integral with a tube 10*e* of the main member 10*a*, the cover wall 12 including a central opening 12*a* with a forwardly projecting electrode supporting tube 13 sealingly engaged therein. A high-voltage generator 14 is centrally disposed in the barrel main member 10*a*, said generator having an outer diameter which is slightly smaller than the inner diameter of the tubular barrel main member 10*a* such that an annular gap 15 is left free. The high-voltage generator 14 comprises spacer legs 14*a* causing a gap 16 to be left between the forward end face of the high-voltage generator 14 and the cover wall 12, said gap 16 being in open communication with the annular gap 15, on the one hand, and with the interior 13*a* of the electrode supporting tube 13, on the other hand.

The barrel extension 10*b* is shaped substantially as a cylinder the mouth portion 10*c* is a rearward portion configured as a tubular member for engagement over the barrel main member 10*a*. The mouth portion 10*c* is provided with internal threads by means of which the barrel extension 10*b* can be screwed down on the externally threaded portion of the barrel main member 10*a*. Also, the barrel extension 10*b* includes a sleeve 10*g* interfit within the barrel extension 10*b*, the sleeve having a central internal bore 10*f* through which the electrode supporting tube 13 is passed in axially forward direction. A toroidal powder duct 17 is cut from, or formed within, the central portion of the barrel extension 10*b* and concentrically surrounds the electrode supporting tube 13, said powder duct extending in forward direction to form an annular powder channel 18 which opens to the outside at the front end of the extension 10*b* while being expanded in diffuser fashion. An inlet port 19, to which a supply hose for the powder-air mixture may be connected (not shown), opens tangentially and at a forward inclination into the toroidal powder duct 17.

Upstream of the opening of the electrode supporting tube 13 there is located a deflector body 20, which can be formed integral with the sleeve 10*g*, including a forwardly protruding needle electrode 21. Said deflector body 20 can be retained to the electrode supporting tube 13 by means of cross-pins. The deflector body 20 provides a flared outside surface 20*a*. Inside the deflector body 20 there extend air ducts 22 in parallel flow arrangement with the electrode 21 and in communication with the interior space of the electrode supporting tube 13. The electrode 21 itself is connected to the high-voltage output of the high-voltage generator 14 via a high-voltage cable 23 passing through the interior space of the electrode supporting tube 13. Finally, a muzzle ring 24 is fitted onto the front portion of the barrel extension 10*b*.

The powder-coating gun operates as described below. Through the non-illustrated supply hose a powder-air-mixture is fed in the direction of the arrow B through the inlet port 19 along a helical-tangential path into the toroidal powder duct 17 from where the mixture reaches the annular channel 18 and flows therethrough to the outside. Due to the diffuser-like expansion of the annular channel 18 and the action of the deflector body 20 a cloud of powder is created which will expand very early whereby both the charging and the transport of the powder are favorably affected.

Charging of the powder occurs by the electrode 21 which, as already noted, is connected to a high voltage. From the non-illustrated rearward area of the coating gun, pressurized air is supplied as flushing air in the direction of the arrows A. This flushing air passes through the annular gap 15 and via the end gap 16 and the interior of the electrode supporting tube 13 reaches the ducts 22 from which it exits as fine air jets surrounding the electrode 21. In the region of the gaps 15, 16 the flushing air provides for the removal of static charges and in the region of the electrode 21 it provides for keeping the electrode clean.

FIG. 3 shows a modification intended to obtain a fan jet of powder. As compared with the embodiment shown in FIG. 1, the muzzle ring 24 used therein has been replaced by a cap 30 including a slotted nozzle 31 through which the needle electrode 21 protrudes. Of course, in this embodiment the deflector body 20 is also omitted. It is precisely with this embodiment that the pressurized air which exits from the interior of the electrode supporting tube 13 and flows around the needle electrode 21 is of paramount importance, because it will not only prevent contamination of the needle electrode but above all it prevents clogging of the nozzle slot 31.

The illustrated embodiments are subject to various modifications within the scope of the present invention. Of course, it is not a requirement that the gun barrel 10 is comprised of two parts which can be separated from each other, i.e., the main member 10*a* and the extension 10*b* can be one piece; however, the illustrated division offers the advantages of facilitated manufacture and, above all, of easy dismounting and cleaning of the gun. Also, the annular channel 18 may have a constant diameter along its entire length and may even narrow down towards the muzzle opening. Finally, it should be noted that the high—voltage generator 14 may merely be the final stage (cascade) of the generator circuit.

Although the present invention has been described with reference to a specific embodiment, those of skill in the art will recognize that changes may be made thereto without departing from the scope and spirit of the invention as set forth in the appended claims.

I claim as my invention:

1. An electrostatic powder-coating gun having a gun barrel, comprising:

a powder duct which is connectable to a supply conduit for a powder-air-mixture and is arranged along the longitudinal axis of the gun barrel towards the work to be coated and terminating in a mouth;

a high-voltage generator which is connectable to a power supply line;

an electrode supporting tube extending through the powder duct in axial direction thereof; and a high-voltage electrode which is carried by the supporting tube and which protrudes beyond the mouth of the powder duct towards the work and is connected to the high-voltage generator via a conductor passing through the supporting tube, wherein the high-voltage generator and the powder duct are disposed in series along the longitudinal axis of the gun barrel, and wherein the powder duct comprises a toroidal powder duct coaxial with the electrode supporting tube and an annular channel extending to said mouth, and a supply port for the powder-air-mixture, extending into the toroidal powder duct tangentially, at an inclination to the longitudinal axis.

2. The electrostatic powder-coating gun as claimed in claim 1, wherein the high-voltage generator is disposed within the gun barrel and an annular gap is arranged between the high-voltage generator and an inner wall of the gun barrel, said annular gap being flow connectable to a pressurized-air supply means, and in flow communication with the interior space of the electrode supporting tube, said interior space opening adjacent the high-voltage electrode.

3. The electrostatic powder-coating gun as claimed in claim 2, wherein the high-voltage electrode is located on a deflector body which is mounted to the electrode supporting tube, and the deflector body includes air flow openings.

4. The electrostatic powder-coating gun as claimed in claim 1, wherein the high-voltage electrode is located on a deflector body which is mounted to the electrode supporting tube.

5. The electrostatic powder-coating gun as claimed in claim 1, wherein the annular powder channel is conically enlarged from the toroidal powder duct towards the mouth thereof.

6. The electrostatic powder-coating gun as claimed in claim 1, wherein a cap including a slotted nozzle is fitted onto the powder duct covering said mouth, the high-voltage electrode protruding through the slotted nozzle.

7. The electrostatic powder-coating gun as claimed in claim 1, wherein the gun barrel comprises a barrel main member and a barrel extension coupled thereto.

8. An electrostatic powder-coating gun, comprising:

a gun housing;

a powder duct within said housing and having a supply port flow connectable to a supply conduit for a powder-air-mixture, arranged along a longitudinal axis of the gun toward the work to be coated;

a high-voltage generator connectable to a power supply, said generator disposed within said gun housing;

an electrode supporting tube extending through the powder duct along the longitudinal axis thereof;

a high-voltage electrode mounted to the supporting tube and protruding beyond a mouth of the powder duct towards the work, connected to the high-voltage generator via a conductor passing through the supporting tube, the powder duct comprising a toroidal powder duct coaxial with the electrode supporting tube and opening into an annular channel extending along the longitudinal axis of the powder duct to the mouth, the supply port for the powder-air-mixture flow connected into the toroidal powder duct tangentially.

9. The electrostatic powder-coating gun as claimed in claim 8, wherein said supply port is arranged flow connected to said toroidal powder duct at an inclination to the longitudinal axis thereof.

10. The electrostatic power-coating gun as claimed in claim 8, wherein the gun housing comprises a gun barrel and the high-voltage generator and the powder duct are disposed in series along the longitudinal axis of the gun barrel.

11. The electrostatic power-coating gun as claimed in claim 10, wherein said powder duct is arranged in an extension piece, and the high-voltage electrode is arranged in a main piece, both the extension piece and the main piece being arranged along the longitudinal axis of the gun barrel, said main piece having a pressurized air conduit formed therethrough, and said pressurized air conduit being flow connectable to a source of pressurized air, said extension piece attachable to said main piece, said electrode supporting tube having an open base end and an open distal end adjacent said electrode, wherein said pressurized air conduit is flow open to said electrode supporting tube at said base end for passing pressurized air therethrough.

12. The electrostatic powder-coating gun as claimed in claim 11, wherein said electrode is mounted coaxially protruding from said open distal end of said electrode supporting tube and said electrode supporting tube comprises discreet air passages at said open distal end.

13. The electrostatic power-coating gun as claimed in claim 8, wherein said electrode supporting tube terminates in a flared deflector body having a deflecting surface on an outside thereof.

14. The electrostatic powder-coating gun as claimed in claim 8 further comprising a cap mounted to said mouth of said powder duct and extending toward the work and surrounding said electrode supporting tube, said cap having an aperture at a terminal end thereof, said high-voltage electrode protruding through said aperture.

15. The electrostatic powder-coating gun as claimed in claim 14, wherein said aperture comprises a slotted configuration.

* * * * *